US008336445B2

(12) United States Patent
Morriss et al.

(10) Patent No.: US 8,336,445 B2
(45) **Date of Patent: *Dec. 25, 2012**

(54) FLUID OPERATED PUMP

(75) Inventors: Gordon Leith Morriss, Shelley (AU); Robert Leslie West, Hillarys (AU)

(73) Assignee: Weir Minerals Netherlands B.V., Venlo (NL)

( * ) Notice: Subject to any disclaimer, the term of this patent is extended or adjusted under 35 U.S.C. 154(b) by 43 days.

This patent is subject to a terminal disclaimer.

(21) Appl. No.: 12/659,554

(22) Filed: Mar. 12, 2010

(65) Prior Publication Data

US 2010/0272581 A1 Oct. 28, 2010

Related U.S. Application Data

(63) Continuation of application No. 10/522,732, filed as application No. PCT/AU03/00953 on Jul. 29, 2003, now Pat. No. 7,707,925.

(30) Foreign Application Priority Data

Jul. 29, 2002 (AU) ..... 2002950421

(51) Int. Cl.
*F01B 19/04* (2006.01)

(52) U.S. Cl. ..... 92/92; 92/130 C; 417/521

(58) Field of Classification Search ..... 417/375, 417/390, 392, 393, 394, 478, 472, 521, 534, 417/539; 166/75.12; 92/92, 90, 91, 130 C
See application file for complete search history.

(56) References Cited

U.S. PATENT DOCUMENTS

| | | | | |
|---|---|---|---|---|
| 1,514,875 | A | 11/1924 | Stringer et al. | |
| 2,027,104 | A | 1/1936 | Kahr et al. | |
| 2,960,038 | A | 11/1960 | Lupfer et al. | |
| 2,971,465 | A | 2/1961 | Eugene | |
| 3,087,433 | A | 4/1963 | Cerveny | |
| 3,250,226 | A * | 5/1966 | Voelker | 417/339 |
| 3,253,549 | A | 5/1966 | Vincent et al. | |
| 3,406,633 | A | 10/1968 | Schomburg | |
| 3,427,987 | A | 2/1969 | Eull | |
| 3,597,517 | A | 8/1971 | Smith | |
| 3,774,572 | A * | 11/1973 | Borraccio | 116/67 R |
| 4,039,269 | A * | 8/1977 | Pickering | 417/475 |

(Continued)

FOREIGN PATENT DOCUMENTS

| | | |
|---|---|---|
| AU | 45786/79 | 4/1979 |

(Continued)

*Primary Examiner* — Devon Kramer
*Assistant Examiner* — Dnyanesh Kasture
(74) *Attorney, Agent, or Firm* — Harness, Dickey & Pierce, P.L.C.

(57) ABSTRACT

Disclosed is a pumping system comprising a pump having a rigid outer casing defining an interior space and a tube structure in the interior space, the tube structure being flexible and substantially inelastic. The interior of the tube structure defines a pumping chamber for receiving pumped fluid. The tube structure is movable between laterally expanded and collapsed conditions thereby providing discharge and intake strokes. The pumping chamber receives pumped fluid to cause the tube structure to move towards the expanded condition and undergo an intake stroke. The pumping chamber—undergoes a discharge stroke upon collapsing of the tube structure. The pumping system also comprises a delivery means and a supplying means for delivering pumped fluid to the pumping chamber and for supplying actuating fluid to an actuating region around the tube structure in timed sequence to cause the tube structure to undergo discharge and intake strokes.

39 Claims, 15 Drawing Sheets

U.S. PATENT DOCUMENTS

| | | | | |
|---|---|---|---|---|
| 4,240,812 | A | 12/1980 | Schaefer et al. | |
| 4,257,751 | A | 3/1981 | Kofahl | |
| 4,439,112 | A | 3/1984 | Kitsnik | |
| 4,515,536 | A | 5/1985 | Van Os | |
| 4,543,044 | A | 9/1985 | Simmons | |
| 4,886,432 | A | 12/1989 | Kimberlin | |
| 5,114,319 | A | 5/1992 | Faber | |
| 5,223,010 | A | 6/1993 | Saunders et al. | |
| 5,897,530 | A | 4/1999 | Jackson | |
| 5,964,580 | A | 10/1999 | Taga | |
| 6,065,944 | A | 5/2000 | Cobb | |
| 6,345,962 | B1 | 2/2002 | Sutter | |
| 2005/0184087 | A1* | 8/2005 | Zagars et al. | 222/63 |

FOREIGN PATENT DOCUMENTS

| | | |
|---|---|---|
| GB | 992 326 | 5/1965 |
| GB | 2 195 149 | 3/1988 |
| JP | 11-117872 | 4/1999 |
| WO | WO 82/01738 | 5/1982 |

* cited by examiner

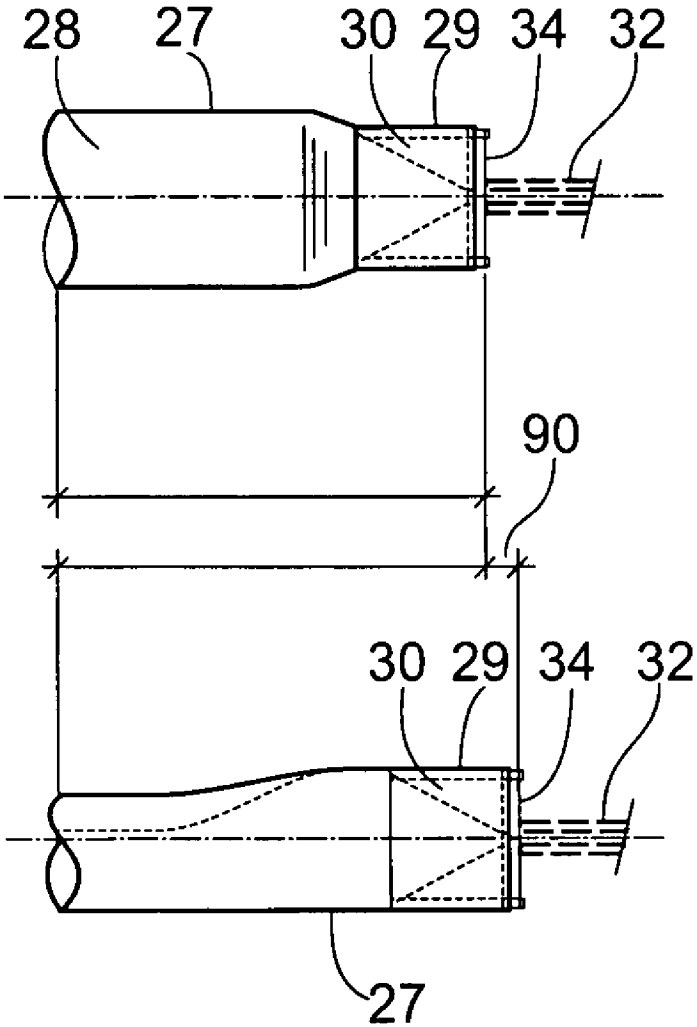
Fig. 14
Fig. 16
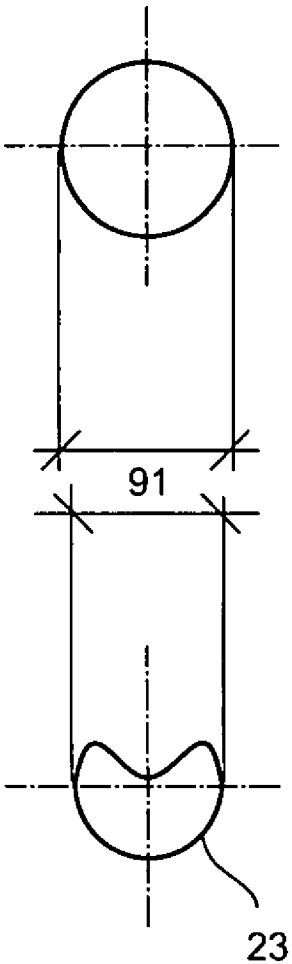
Fig. 15
Fig. 17

Fig. 18

| | CHAMBER 21 | | | | CHAMBER 22 | | | |
|---|---|---|---|---|---|---|---|---|
| Reference | Valve 84 | Valve 85 | Valve 86 | Description | Valve 84 | Valve 85 | Valve 86 | Description |
| Figure 3 | Closed | Closed | OPEN | Tube 27 fills, fluid in the chambers 40, 41 returns to tank until the Tube is FULL | Closed | Closed | OPEN | Tube 27 fills, fluid in the chambers 40, 41 returns to tank until the Tube is FULL |
| | Control system Instrumentation must confirm this Tube 27 FULL status before proceeding to the next step | | | | | | | |
| Figure 4 | Closed | Closed | Closed | Tube 27 remains FULL | OPEN | Closed | Closed | Chamber 40, 41 is pressurised to the system operating pressure |
| Figure 5 | Closed | Closed | Closed | Tube 27 remains FULL | OPEN | OPEN | Closed | Pump stroke commences |
| Figure 6 | OPEN | Closed | Closed | Chamber 40, 41 is pressurised to the system operating pressure | Closed | OPEN | Closed | Pump stroke continues |
| Figure 7 | OPEN | OPEN | Closed | Pump stroke commences | Closed | OPEN | Closed | Pump stroke finishing |
| Figure 8 | OPEN | OPEN | Closed | Pump stroke continues | Closed | Closed | OPEN | Tube 27 starts filling and fluid in chambers 40, 41 returns to tank |
| Figure 9 | OPEN | OPEN | Closed | Pump stroke continues | Closed | Closed | Closed | Tube 27 is FULL, control system instrumentation must confirm FULL Tube status before proceeding to the next step |
| Figure 10 | Closed | OPEN | Closed | Pump stroke continues | OPEN | Closed | Closed | Chamber 40, 41 is pressurised to the system operating pressure |
| Figure 11 | Closed | OPEN | Closed | Pump stroke finishing | OPEN | OPEN | Closed | Pump stroke commences |
| Figure 12 | Closed | Closed | OPEN | Tube 27 starts filling and fluid in chambers 40, 41 returns to tank | OPEN | OPEN | Closed | Pump stroke continues |
| Figure 13 | Closed | Closed | Closed | Tube 27 is FULL, control system instrumentation must confirm FULL Tube status before proceeding to the next step | OPEN | OPEN | Closed | Pump stroke continues |
| | Sequence repeats from Figure 6 | | | | | | | |
| Figure 6 | OPEN | Closed | Closed | Chamber 40, 41 is pressurised to the system operating pressure | Closed | OPEN | Closed | Pump stroke continues |
| Figure 7 | OPEN | OPEN | Closed | Pump stroke commences | Closed | OPEN | Closed | Pump stroke finishing |
| Figure 8 | OPEN | OPEN | Closed | Pump stroke continues | Closed | Closed | OPEN | Tube 27 starts filling and fluid in chambers 40, 41 returns to tank |
| Figure 9 | OPEN | OPEN | Closed | Pump stroke continues | Closed | Closed | Closed | Tube 27 is FULL, control system instrumentation must confirm FULL Tube status before proceeding to the next step |

FLUID OPERATED PUMP

CROSS-REFERENCE TO RELATED APPLICATIONS

This application is a continuation of U.S. patent application Ser. No. 10/522,732 filed on Jan. 28, 2005 now U.S. Pat. No. 7,707,925, which is a National Stage of International Application No. PCT/AU2003/000953, filed Jul. 29, 2003 which claims priority to Australian Patent Application No. 2002950421, filed on Jul. 29, 2002. The disclosures of each of the above applications are incorporated herein by reference in their entirety.

FIELD OF THE INVENTION

This invention relates to a fluid operated pump and to a pumping system incorporating such a pump.

BACKGROUND ART

The invention has been devised particularly, although not necessarily solely, for dewatering underground mining operations. The invention is suited to applications where very high pressures are required to pump large volumes of soiled fluids. Typically, pressures in the ordered of 2500 m water head and flow rates in the order of 200 m3/hr can be achieved.

In dewatering of underground mining operations, the water is invariably contaminated with solids. Typically, piston plunger pumps or piston diaphragm pumps are used for the pumping process. While piston pumps are effective in operation, they involve high capital costs and also high maintenance costs. The high maintenance costs arise due to the high wear rates, which result from, the arduous operating conditions of the pump valving systems which regulate the pumps intake and discharge strokes. Such systems involve pump-operating rates of some 60 to 80 cycles per minute. A further contributing factor to the high maintenance costs for piston plunger pumps is the aggressive action of the contaminated water on the reciprocating pistons and their seals.

Diaphragm pumps are not exposed to the same wear rates on the pistons and seals but nevertheless the valving systems are exposed to the same arduous conditions as diaphragm pumps also operate at some 60 to 80 cycles per minute.

There is a need for a pump which can operate at lower pumping rates and therefore be less arduous on valving associated with the pump. This requirement can be met by a collapsible chamber pump, which is a variation of a peristaltic pump. Such a pump utilises a flexible tube having a supply end and a discharge end, with a pumping chamber defined within the tube between the supply and discharge ends. Fluid pressure is employed to compress the tube, thereby urging a charge of the fluid within the pumping chamber towards the discharge end. Various proposals for such pumps are disclosed in U.S. Pat. No. 3,406,633 (Schomburg), U.S. Pat. No. 4,515,536 (van Os), U.S. Pat. No. 6,345,962 (Sutter), GB 2195149 (SB Services (Pneumatics) Ltd), WO 82/01738 (RIHA), U.S. Pat. No. 4,257,751 (Kofahl) and U.S. Pat. No. 4,886,432 (Kimberlin).

Each of these proposals utilise a flexible tube which is elastic so that it is compressible to expel the charge of fluid therein and expandable to receive a further charge of pumped fluid into the flexible tube. Each of these proposals has limitations on the maximum pressure to which the device can operate. The limitation is a result of the maximum pressure differential the flexible tube can withstand if the tube is over-compressed by the pumping fluid. If over-compressed the tube will fail by rupturing at the outlet port.

It is against this background, and the deficiencies and problems associated therewith that the present invention has developed.

The reference to the abovementioned prior art is for the purposes of background only and is not, and should not be taken as, an acknowledgement or any form of suggestion that the prior art forms part of the general knowledge in Australia.

DISCLOSURE OF THE INVENTION

According to a first aspect of the invention there is provided a pump for conveying a pumped fluid using a actuating fluid, the pump comprising a rigid outer casing defining an interior space, a tube structure accommodated in the interior space, the tube structure being flexible and substantially inelastic, the interior of the tube structure defining a pumping chamber for receiving pumped fluid, the tube structure being movable between laterally expanded and collapsed conditions for varying the volume of the pumping chamber thereby to provide discharge and intake strokes, the region of the interior space surrounding the tube structure defining an actuating region for receiving and accommodating actuating fluid, the pumping chamber being adapted to receive pumped fluid to cause the tube structure to move towards the expanded condition and the pumping chamber thereby undergoing an intake stroke, the pumping chamber undergoing a discharge stroke upon collapsing of the tube structure in response to the action of actuating fluid in the actuating region.

Preferably, one end of the tube structure is closed and the other end is connected to a port through which pumped fluid can enter into and discharge from the pumping chamber as the pumping chamber performs intake and discharge strokes.

Preferably, the tube structure is maintained in a taut condition between the ends thereof.

Preferably, the tube structure is supported at the closed end thereof.

Preferably, the closed end of the tube structure is movably supported to accommodate longitudinal extension and contraction of the tube structure. The closed end of the tube structure may be movably supported in any appropriate fashion such as by way of a spring mechanism.

Preferably the actuating region comprises an actuating annulus substantially surrounding the tube structure and an actuating chamber located at the closed end of the pump. Preferably the actuating annulus is in fluid communication with the actuating chamber.

Preferably the pump comprises means to bled fluid, such as air, therefrom.

Preferably the pump comprises separate means to bled air from the pumping chamber and from the actuating region, wherein the air is bled from the pumping chamber during the intake stroke and air is bled from the actuating region during the discharge stroke.

The pump may also comprise a monitoring means to monitor the pump during the intake and discharge stroke.

Preferably the monitoring means monitors the condition of the tube structure.

According to one embodiment of the invention the monitoring means monitors, directly or indirectly, the position of the closed end of the tube structure. Hence, as the tube structure fills, the longitudinal length is caused to contract, resulting in the movable closed end moving towards the fixed open end of the tube structure.

According to another embodiment of the invention the monitoring means monitors the pressure differential between components of the pump.

Preferably the monitoring means at least indicates when the discharge and intake strokes have been completed.

According to a second aspect of the invention there is provided a pumping system comprising a pump in accordance with the first aspect of the invention, a delivery means for delivering pumped fluid to the pumping chamber in timed sequence for causing the pumping chamber to undergo an intake stroke, and means for supplying actuating fluid to the actuating region in timed sequence to cause the tube structure to laterally collapse whereby the pumping chamber undergoes a discharge stroke.

The delivery means may comprise a delivery pump.

Typically, the delivery means is only required to operate at a relatively low pressure in the sense that is only required to convey the pumped fluid into the interior of the tube structure to cause lateral expansion thereof and thereby performing an intake stroke of the pumping chamber.

The actuating fluid may be of any appropriate form, such as hydraulic oil or water.

In the case where the actuating fluid is hydraulic oil, the supply means preferably includes a hydraulic circuit incorporating a reservoir for hydraulic oil and a hydraulic pump. The hydraulic circuit also includes an intake and exit valve system for regulating the delivery of hydraulic oil into, and the discharge of hydraulic oil from, the actuating region in timed sequence.

In the case where the actuating fluid is water, the supply means may comprise a water reservoir at an elevated location in order to supply the water at the appropriate pressure head.

Preferably the delivery of the actuating fluid to the actuating region is at an opposed end to the port through which pumped fluid enters into and discharges from the pumping chamber. The outlet of the actuating fluid from the actuating region may also be at an opposed end to the port through which pumped fluid enters into and discharges from the pumping chamber.

The pumping system may comprise two pumps in accordance with the first aspect of the invention operating sequentially such that the pumping chamber of one pump performs a intake stroke while the pumping chamber of the other pump performs a discharge stroke, and vice versa.

Preferably the sequential operation of the two pumps is such that a generally uninterrupted supply of pumped fluid is expelled from the pumping system. This is in contrast to the prior art pumping systems which discharge a given volume of fluid from the flexible tube and then requires the tube to refill prior to subsequent displacements. This results in intermittent output flow of the device that is generally undesirable. When used in extreme high-pressure applications the intermittent output flow will give rise to shock waves (also known as hydraulic hammer) occurring in the outlet piping system. Intermittent flow in the outlet piping system will require the flow to repeatedly accelerate then decelerate resulting in energy consumption and hence inefficiency of the pumping system.

The duration of the discharge stroke may be longer than the duration of the intake stroke. Preferably one pump completes its intake stroke and commences its discharge stroke while the other pump is completing its discharge stroke. Preferably the discharge stroke of one pump is completed by the time the discharge from the other pump is equal in flow to the desired flow of pump fluid from the pumping system.

Preferably, the two pumps have a common delivery means and a common supply means, with appropriate valve systems controlling the sequence of operation.

Preferably, the, or each pump is oriented so that the closed end of the tube structure is elevated in relation to the other end thereof. Preferably the delivery and exit of the actuating fluid to the actuating region is adjacent the closed end.

According to a third aspect of the invention there is provided a pump for conveying a pumped fluid using a actuating fluid, the pump comprising a rigid outer casing defining an interior space, a flexible tube structure accommodated in the interior space, the interior of the tube structure defining a pumping chamber for receiving pumped fluid, the tube structure being movable between laterally expanded and collapsed conditions for varying the volume of the pumping chamber thereby to provide discharge and intake strokes, one end of the tube structure being closed and the other end communicating with a port through which pumped fluid can enter into and discharge from the pumping chamber as the pumping chamber performs the intake and discharge strokes, the region of the interior space surrounding the tube structure defining an actuating region for receiving actuating fluid, the pumping chamber being adapted to receive pumped fluid to cause the tube structure to move towards the expanded condition and the pumping chamber thereby undergoing an intake stroke, the pumping chamber undergoing a discharge stroke upon collapsing of the tube structure in response to the action of actuating fluid in the actuating region.

Preferably the tube structure is substantially inelastic.

Preferably the part through which pumped fluid enters the pumping chamber is at an opposed end to where the actuating fluid enters the pump.

According to a fourth aspect of the invention there is provided a pumping system comprising at least two pumps each having a pumping chamber accommodated in an actuating region, a delivery means for delivering pumped fluid to each pumping chamber in timed sequence, causing each pumping chamber to undergo an intake stroke, and means for supplying actuating fluid to each actuating region in timed sequence to cause the respective tube structure to laterally collapse whereby the pumping chamber undergoes a discharge stroke, whereby the sequential operation of the at least two pumps expels a generally uninterrupted supply of pump fluid from the pumping system.

Preferably each pumping chamber comprises a flexible and substantially inelastic tube structure.

Preferably the pumping chamber has one end closed and the other end connected to a port through which pumped fluid can enter into and discharge from the pumping chamber as the pumping chamber performs intake and discharge strokes. Preferably the closed end of the pumping chamber is elevated in relation to the other end thereof.

According to a fifth aspect of the invention there is provided a method of operating a pumping system in accordance with the fourth aspect of the invention wherein the duration of the discharge stroke of one pump is longer than the duration of the intake stroke of the other pump, and vice versa, whereby, when operated sequentially, the pumping system delivers a generally uninterrupted supply of fluid.

According to a sixth aspect of the invention there is provided a pump for conveying a pumped fluid using an actuating fluid, the pump comprising a rigid outer casing defining an interior space, a tube structure accommodated in the interior space, the tube structure having one end closed and in an elevated position in to relation to the other end, which communicates with a port through which pumped fluid can enter into and discharge from the pumping chamber, the interior of the tube structure defining a pumping chamber for receiving pumped fluid, the tube structure being movable between laterally expanded and collapsed conditions for varying the volume of the pumping chamber thereby to provide discharge and intake strokes, the region of the interior space surrounding the tube structure defining an actuating region for receiving actuating fluid, the pumping chamber being adapted to receive pumped fluid to cause the tube structure to move towards the expanded condition and the pumping chamber thereby undergoes an intake stroke, the pumping chamber undergoing a discharge stroke upon collapsing of the tube structure in response to the action of actuating fluid in the actuating region.

Preferably the actuating fluid enters the actuating region adjacent the closed end of the pumping chamber.

Preferably the tube structure is flexible and substantially inelastic.

According to a further aspect of the invention there is provided a method of operating a pump system comprising at least two pumps which, individually, supply a pulse flow, wherein the at least two pumps are operated in timed sequence to supply an generally uninterrupted discharge from the pump system.

Preferably the duration of the discharge stroke of one of the at least two pumps is longer than the duration of the intake stroke of the other of the at least two pumps and vice versa.

BRIEF DESCRIPTION OF THE DRAWINGS

The invention will be better understood by reference to the following description of a specific embodiment thereof as shown in the accompanying drawings in which:

FIG. 14 is a side view of the closed end of a tube structure forming part of the pumping system, shown in a loaded (laterally expanded) condition;

FIG. 15 is an end view of FIG. 14;

FIG. 16 is a side view of the closed end of the tube structure, shown in a relaxed (laterally collapsed) condition;

FIG. 17 is an end view of FIG. 16; and

FIG. 18 is a table indicating the sequential operation of the pumping system in relation to FIGS. 3 to 13.

BEST MODE(S) FOR CARRYING OUT THE INVENTION

Referring to FIGS. 1 to 13, there is shown a pumping system 1 suitable for transportation of contaminated water in continuous flow, at high pressure and at large flow rates. The contaminated water contains solids and so typically comprises a slurry. Accordingly, the contaminated water will hereafter be referred to as a slurry.

The pumping system 1 comprises two pumps 21,22 operable in timed sequence (as will be explained) in order to discharge slurry by way of a discharge pipeline 56.

Figure 2:
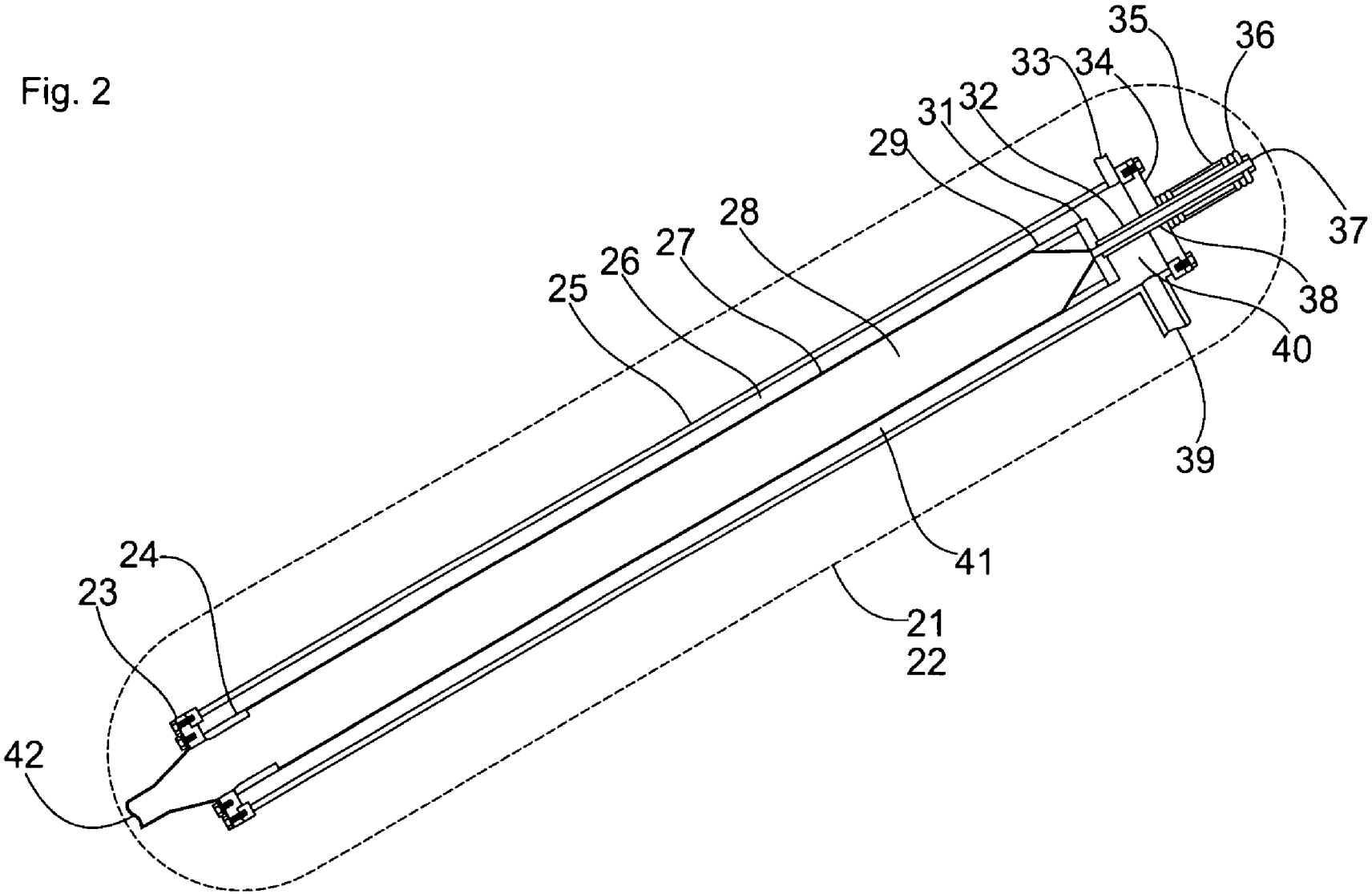
FIG. 2 is a fragmentary view of a pump of the pumping system shown in FIG. 1.

Referring to FIG. 2, each pump 21,22 comprise a rigid outer casing 25 which is of cylindrical construction and which defines an interior space 26. Each casing 25 has a longitudinal axis inclined to the horizontal such that one end thereof is elevated in relation to the other. A first end plate 34 is mounted on the upper end of the casing 25 and a second end plate 23 is mounted on the lower end thereof.

A flexible tube structure 27 is accommodated in the interior space 26 within the outer casing 25 and is supported in a longitudinally taut condition. The flexible tube structure 27 is flexible yet substantially inelastic. The tube structure is substantially inelastic in the sense it does not have a memory tending to cause it to return to a particular state after being deflected therefrom and has tensile strength thereby limiting the elastic stretch of the tube.

The interior of the tube structure 27 defines a pumping chamber 28. Because of its flexible nature, the tube structure 27 is movable between laterally collapsed and expanded conditions for varying the volume of the pumping chamber 28. With this arrangement, the pumping chamber 28 can perform intake and discharge strokes.

In the laterally collapsed condition, the tube structure 27 is relaxed and essentially collapsed upon itself, apart from the ends thereof which are supported in a manner to be explained later. In the laterally expanded condition, the tube structure 27 is inflated and stresses develop in the tube wall. This results in some longitudinal contraction or shortening of the tube structure, as will be described in more detail later.

One end of the tube structure 27 is supported on the lower end plate 23. Specifically, the lower end plate 23 incorporates an opening which defines a port 42 through which slurry undergoing pumping can enter and leave the pumping chamber 28 defined within the tube structure 27. The end plate 23 incorporates a sleeve section 24 onto which the end of the tube structure 27 is sealingly engaged.

The other end of the tube structure 27 is attached to a movable support. The movable support comprises a cylindrical rigid end fitting 29, an end wall section 31 and a conical inner profile section 30. The end of the tube structure 27 is sealingly fitted onto the cylindrical rigid end fitting 29. The end wall section 31 is supported on a tubular rod 32 which extends through an opening 38 in the upper end plate 34. The tubular rod 32 is sealingly and slidingly supported in the end plate 34. The outer end section of the tubular rod 32 is fitted with a collar 36, with a compression spring 35 acting between the collar 36 and the outer face of the end plate 34. With this arrangement, the compression spring 35 urges the tubular rod 32 outwardly and thus the end fitting 29 is urged towards the end plate 34. This arrangement movably supports the upper end of the tube structure 27 and accommodates longitudinal extension and contraction of the tube structure as will be explained later. Additionally, it assists in maintaining the tube structure 27 in the longitudinally taut condition.

The region of the interior space 26 surrounding the tube structure 27, and internal of the rigid outer casing 25, defines an actuating annulus 41 for receiving an actuating fluid. The region external of the circular end wall 31 and internal of the end plate 34 defines an actuating chamber 40 for receiving the actuating fluid, the actuating chamber 40 being in fluid communication with the actuating annulus 41 to provide the actuating region.

Upon commencement, and during the discharge stroke, the actuating fluid enters the actuating chamber 40 via port 39 before passing into the actuating annulus 41. Port 39 is connected to the upper end of outer casing 25 so that the flow of actuating fluid, when entering the actuating chamber 40, is not directly inline with the tube structure 27 and therefore does not impinge thereagainst.

Upon commencement, and during the intake stroke, the actuating fluid passes through the actuating annulus 41 into the actuating chamber 40 before exiting via port 33. Port 33 is connected to the upper end of the outer casing 25 and in the upper most elevated position. This configuration allows for entrapped air to be dispelled from the actuating chamber 40 upon discharge of the actuating fluid.

Figure 1:
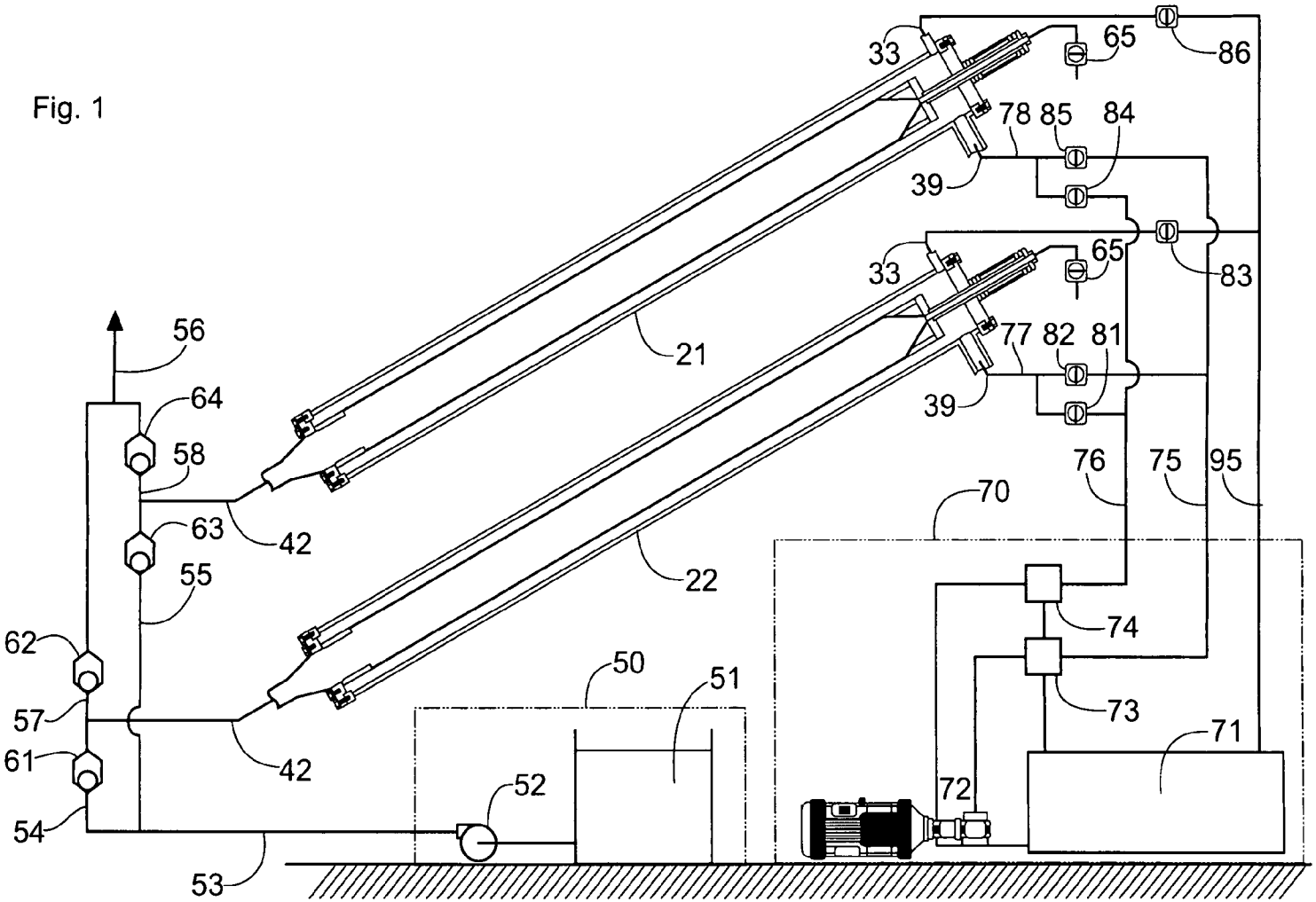
FIG. 1 is schematic elevational view of a pumping system according to an embodiment.

Referring to FIG. 1, the pumping system 1 further includes a delivery means 50 for delivering slurry to the pumping chambers 28 in timed sequence as will be explained. The delivery means 50 communicates with a slurry reservoir 51, and includes a priming pump 52 and a delivery line 53 which extends from the priming pump 52 and which branches into two delivery branch lines 54,55. Specifically, each delivery branch line 54,55 communicates with a respective pumping chamber 28 of the respective pump via port 42. An inlet check valve 61,63 in each respective branch line 54,55 controls the flow direction of slurry along the branch line.

Each port 42 also communicates with the discharge pipeline 56 by way of a respective discharge branch line 57,58. Each respective discharge branch line 57,58 includes an outlet check valve 62,64 for controlling the flow direction of discharging slurry along the branch line.

A supply means 70 is also provided for supplying actuating fluid to each actuating chamber 40 in-timed sequence.

In this embodiment, the actuating fluid is hydraulic oil and the supply means 70 comprises a hydraulic circuit communicating with the actuating chamber 40 of each pump 21,22. The supply means 70 includes a reservoir 71 for hydraulic oil and an electric motor driven hydraulic pump 72 for delivery of hydraulic oil under pressure along branch lines 75,76 to the actuating chambers 40. Hydraulic valves 73,74 enable relief pressure flow in respective branch lines 75,76 back to the reservoir 71.

The actuating chamber 40 of each pump 21,22 communicates with branch lines 75,76 by way of transfer lines 77,78 connected between the respective branch lines 75,76 and the port 39.

Branch line 76 incorporates a precharge inlet valve 81 associated with pump 22, and a precharge inlet valve 84 associated with pump 21. Branch line 75 incorporates a supply inlet valve 82 associated with pump 22 and a supply inlet valve 85 associated with pump 21.

The supply means 70 also comprises return pipeline 95.

Return pipeline 95 is in communication with ports 33 on each pump 21,22 and incorporate discharge valve 86 associated with pump 21 and discharge valve 83 associated with pump 22.

Valves 81 to 86 are adapted to operate in timed sequence under the control of a control system (not shown). Typically, the valves 81 to 86 are operable in response to electrical signals from the control system.

While operation of the valves 81 to 86 is controlled in timed sequence by the control system, it should be noted that valves 61-64 associated with slurry intake into, and discharge from, the pumping chambers 28 are simply check valves which respond to fluid pressures.

As alluded to above, a charge of slurry is expelled from each pumping chamber 28 under the influence of a charge of hydraulic oil entering the surrounding actuating annulus 41 and actuating chamber, 40. The charge of hydraulic oil is spent at the completion of the discharge stroke. The spent charge of hydraulic oil is subsequently expelled from the actuating annulus 41 and actuating chamber 40 by inflation of the tube structure 27 during the next intake stroke of the pumping chamber 28. This sequence is of course controlled by timed actuation of the control valves 81 to 86. Specifically, a discharge stroke for each respective pump 21,22 is performed when the respective inlet valve 82,85 is open and the respective outlet valve 83,86 is closed. Similarly, an intake stroke is performed when the respective outlet valve 83,86 is open and the respective inlet valve 82, 85 is closed. The respective outlet valve 83,86 is open to allow expulsion of the actuating fluid and allow space for the tube structure 27 to move to its expanded condition upon intake of slurry.

To ensure satisfactory operation of the pump, air must be bled from both the actuating annulus 41 and actuating chamber 40, as well as the pumping chamber 28. Port 33 is located at the upper most point of actuating chamber 40 and will discharge air entrapped in the actuating annulus 41 and actuating chamber 40 in each pump 21,22 when respective control valve 83,86 is opened as described prior. Whereas air entrapped in the respective pumping chamber 28 is exited through port 37.

As can be seen in FIG. 2, port 37 is connected to the pump chamber 28 by the hollow tubular rod 32. Conical inner profile section 30 guides entrapped air in the pumping chamber 28 to the hollow tubular rod 32. When an outlet valve 65 in communication with the tubular rod 32 is open and the pumping chamber 28 is caused to fill with slurry during the intake stroke, slurry will flow out through the hollow tubular rod 32 thus forcing entrapped air to be expelled from the pumping chamber 28.

It is to be understood that the expulsion of entrapped air from the pumping chamber 18 may be through a variety of other means such as via a bled tube position at the most elevated position of the tube structure 27.

Operation of the pumping system 1 according to the first embodiment will now be described. The operating sequence is tabulated in FIG. 18.

Figure 3:
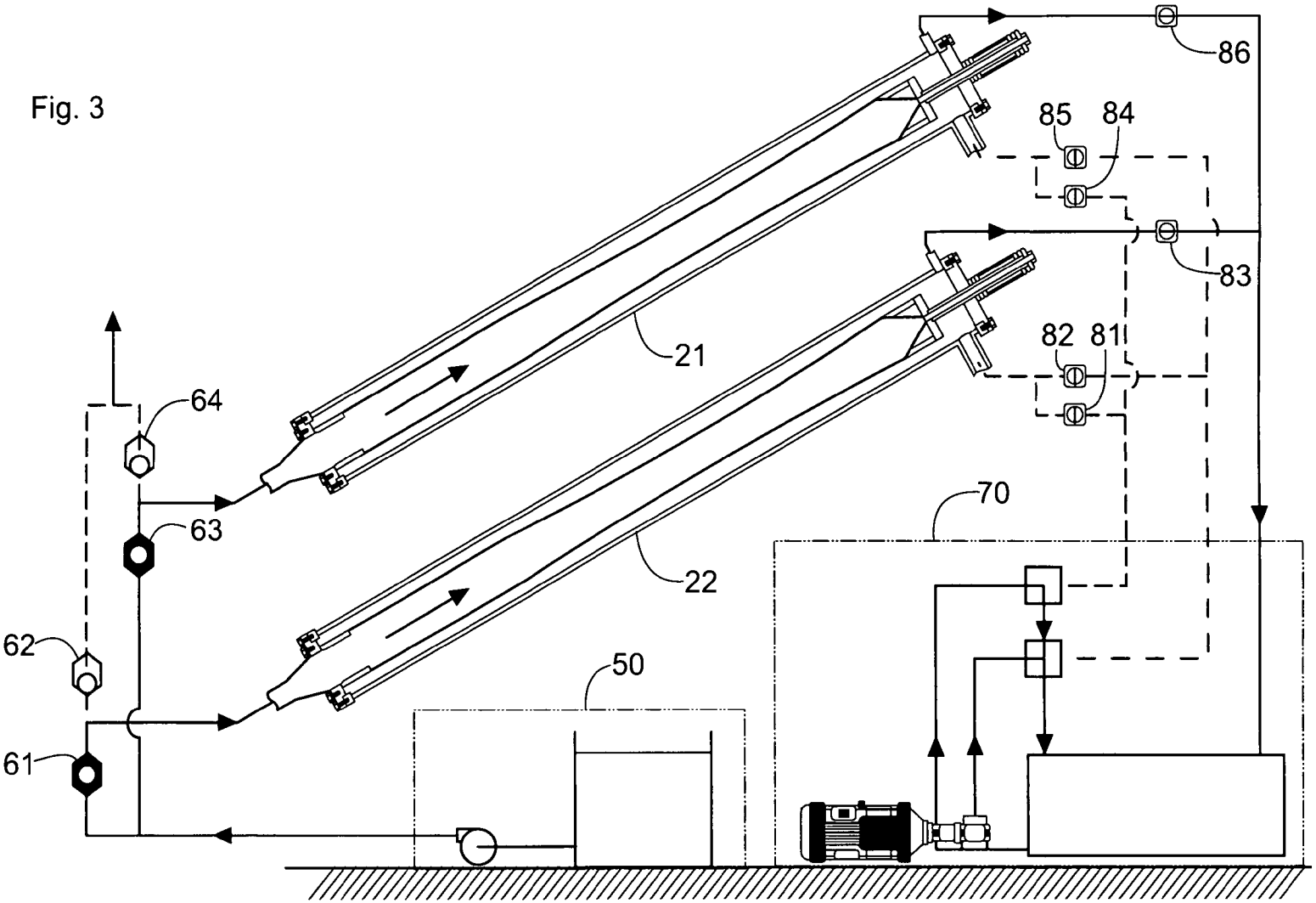
FIGS. 3 to 13 are sequential views of the operation of the pumping system according to the embodiment shown in FIG. 1.
Figure 4:
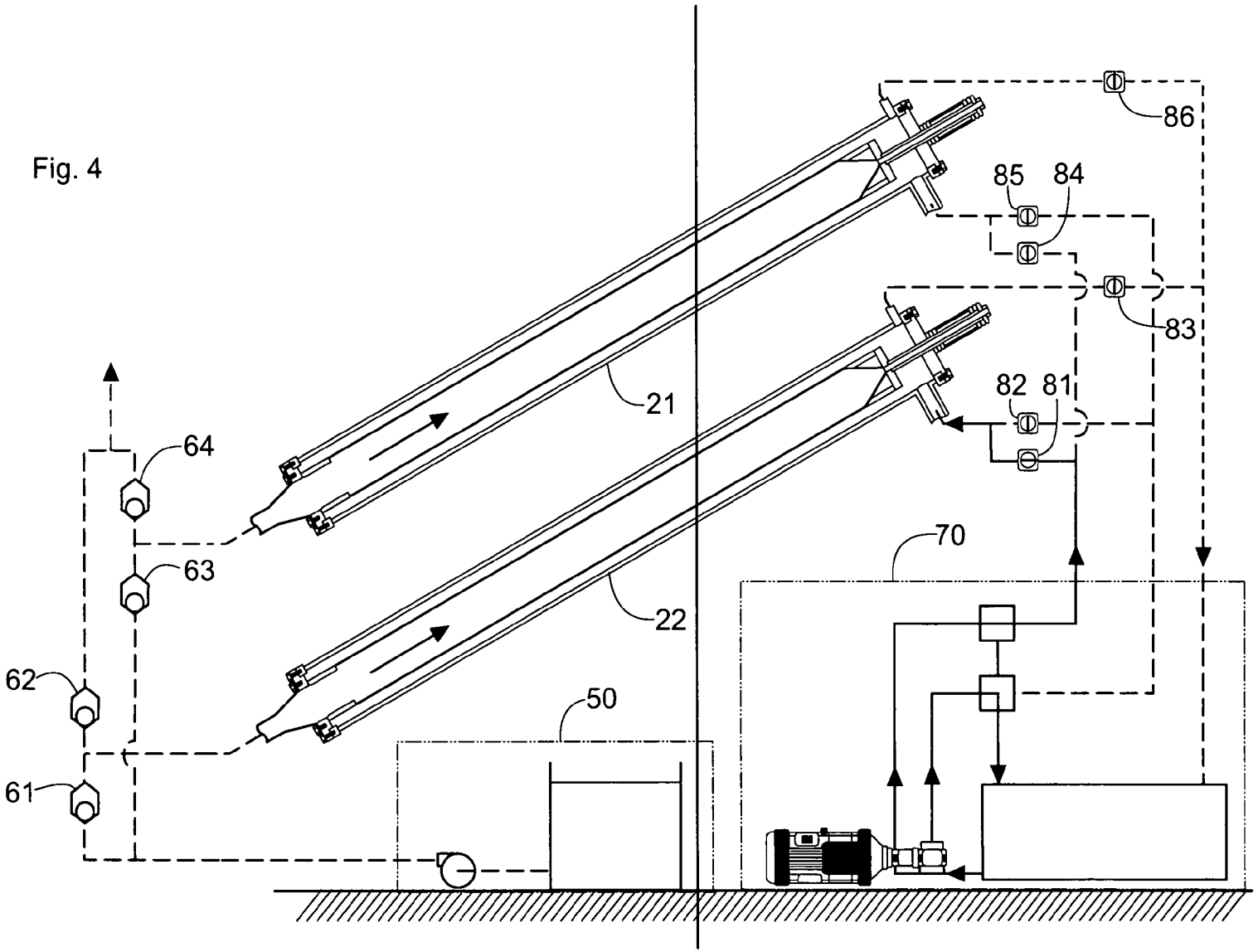

At the commencement of a pumping operation using the pumping system 1, it is necessary to prime both pumps 21,22 so that the pumping chamber 28 of each pump is fully loaded with slurry, as shown in FIGS. 3 and 4.

Figure 5:
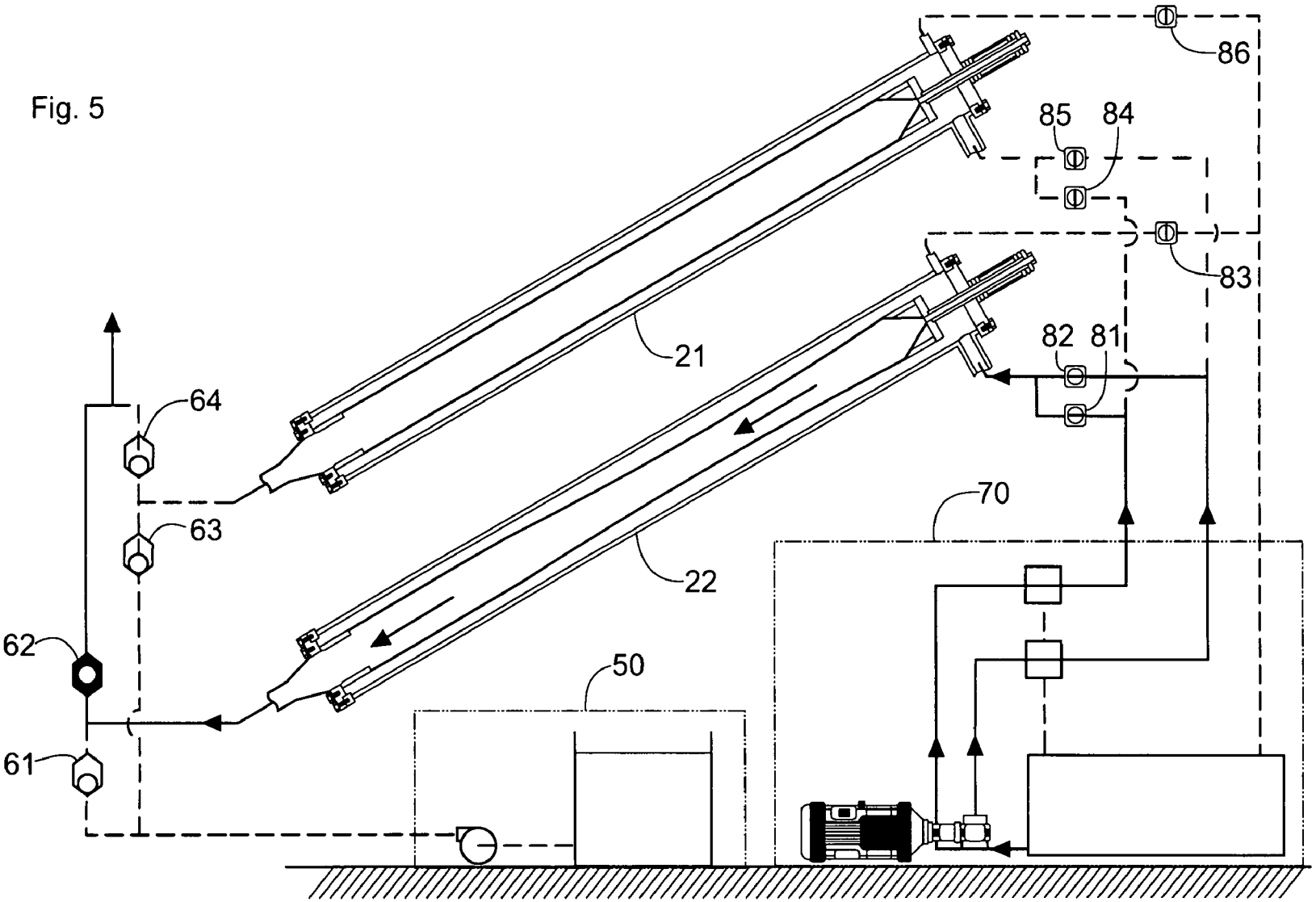
Figure 6:
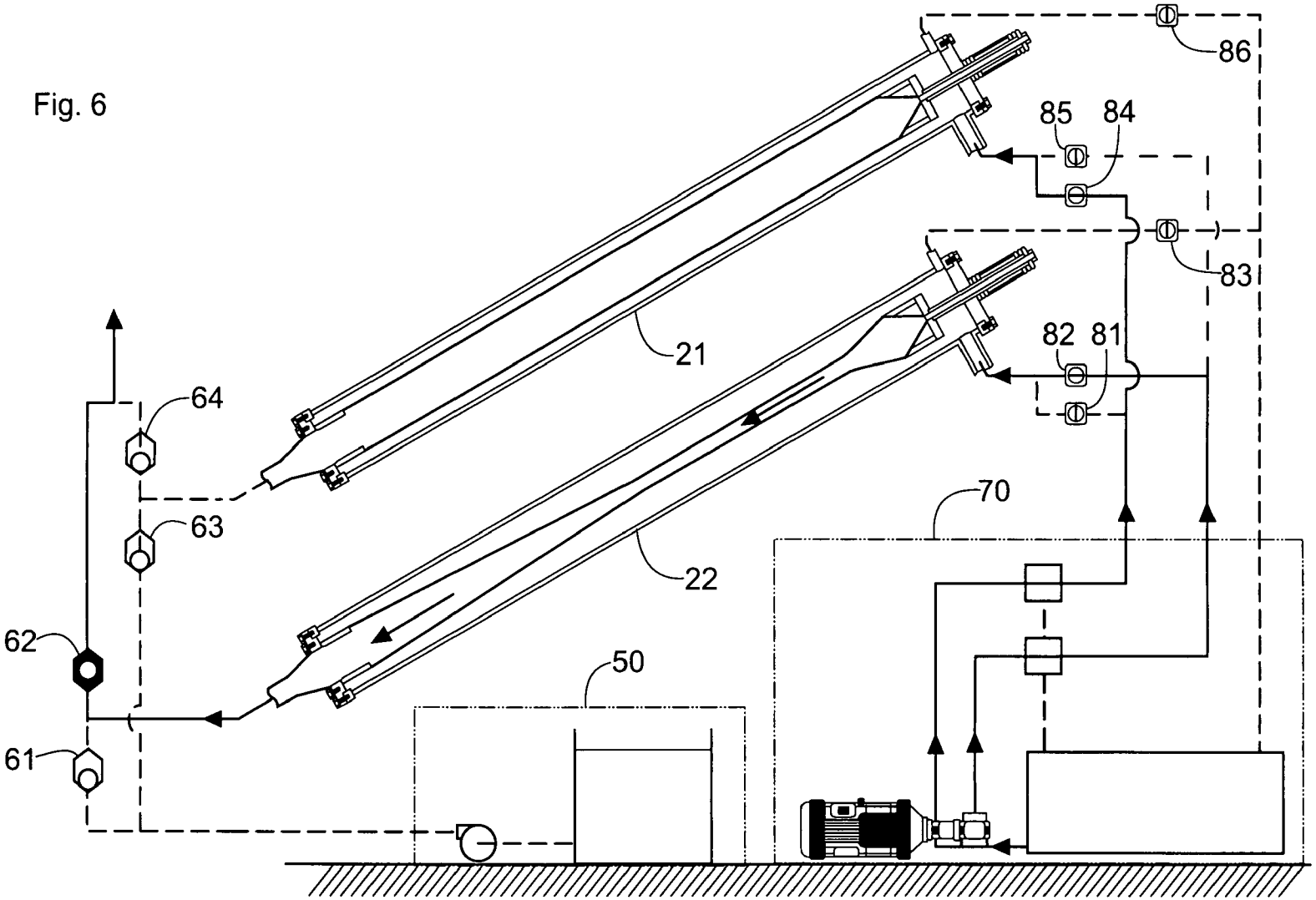
Figure 7:
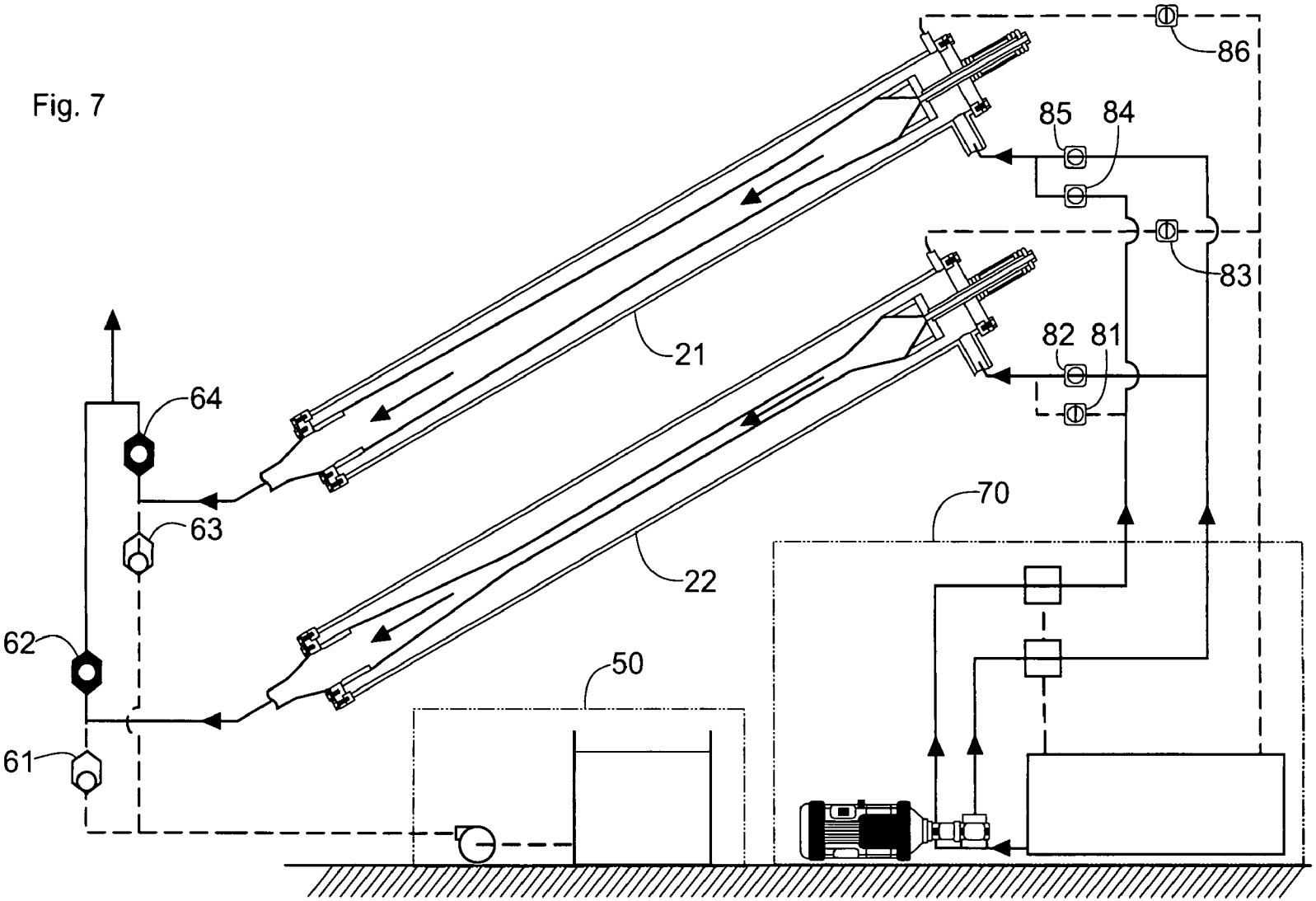
Figure 8:
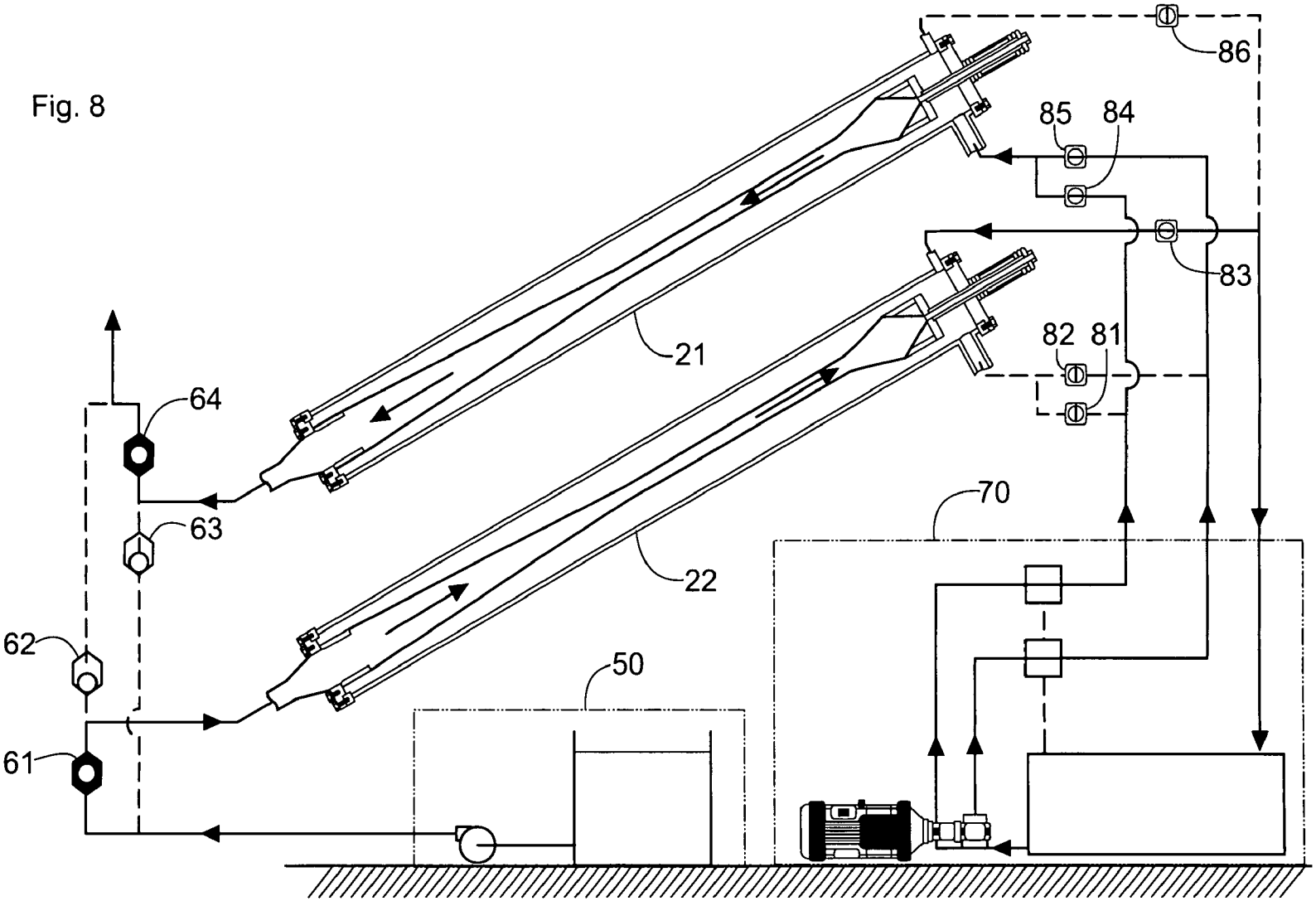
Figure 9:
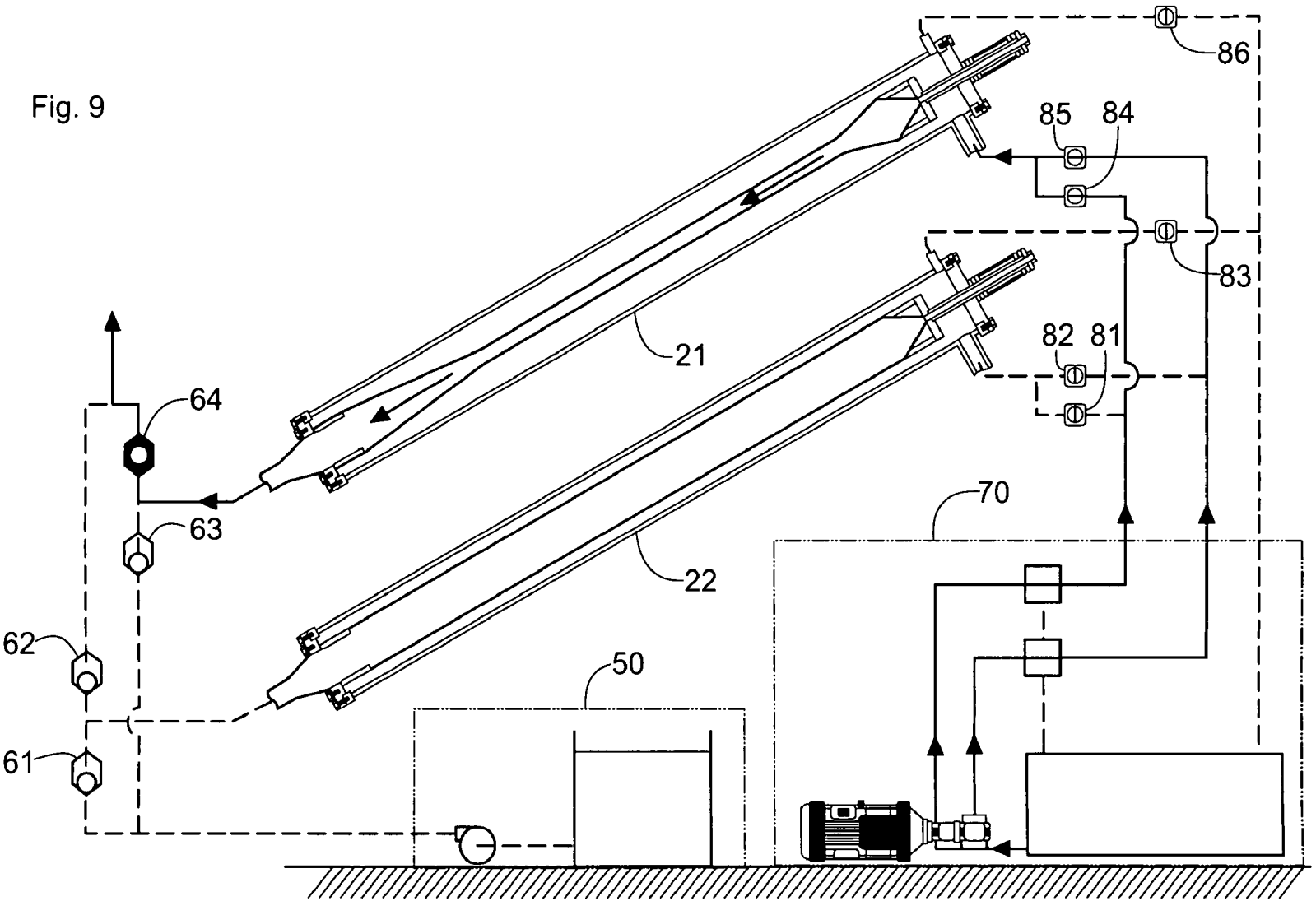
Figure 10:
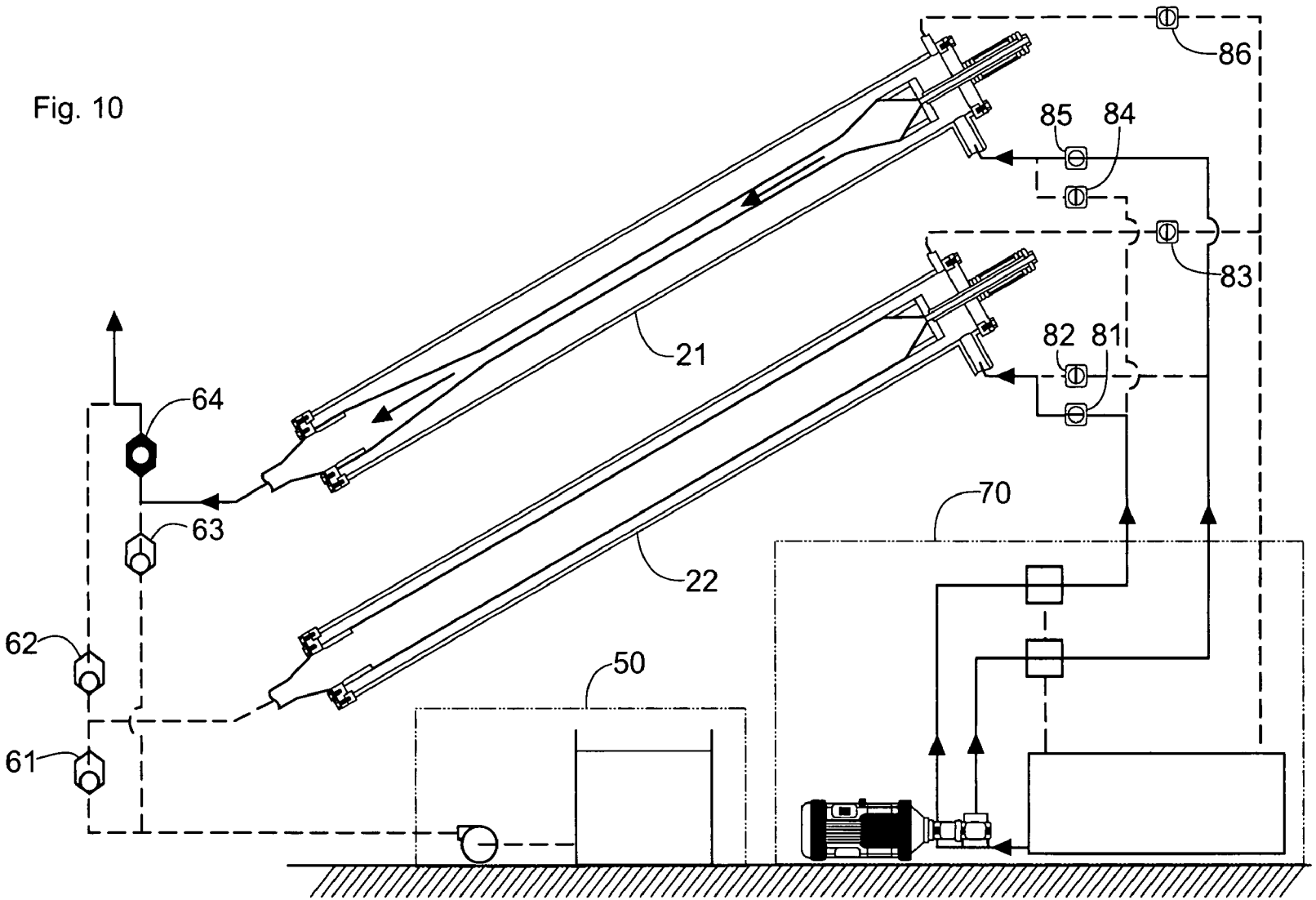
Figure 11:
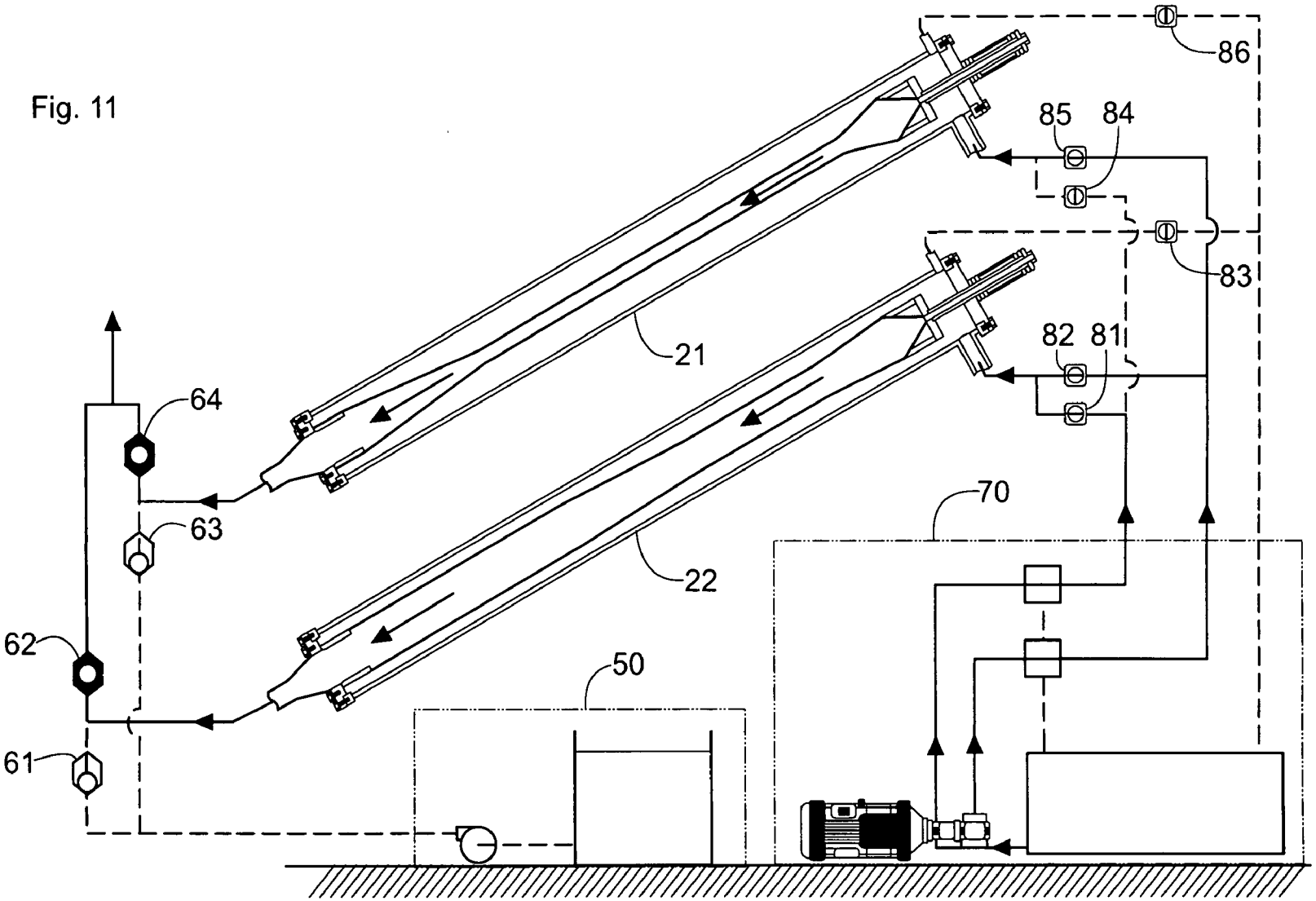
Figure 12:
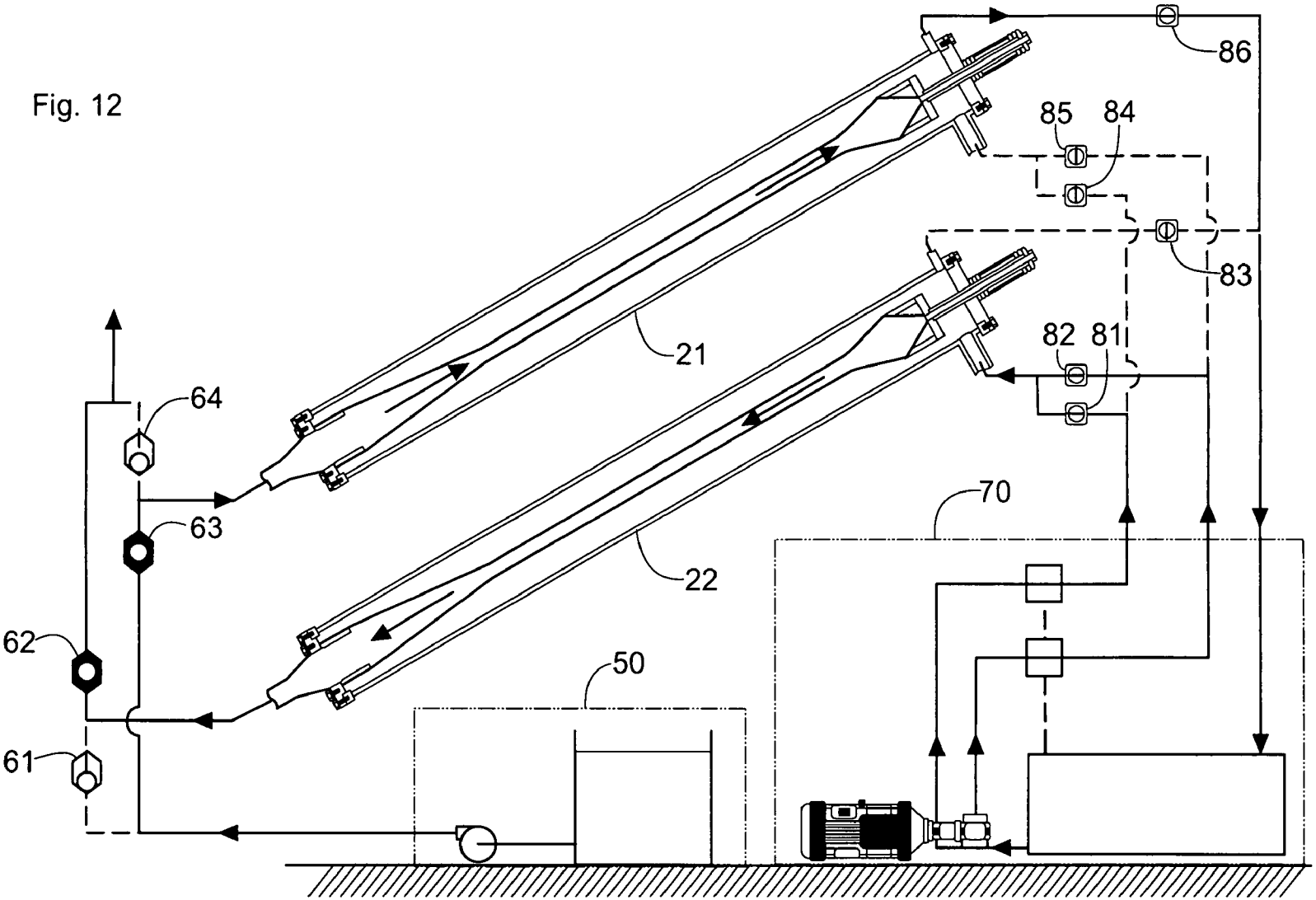
Figure 13:
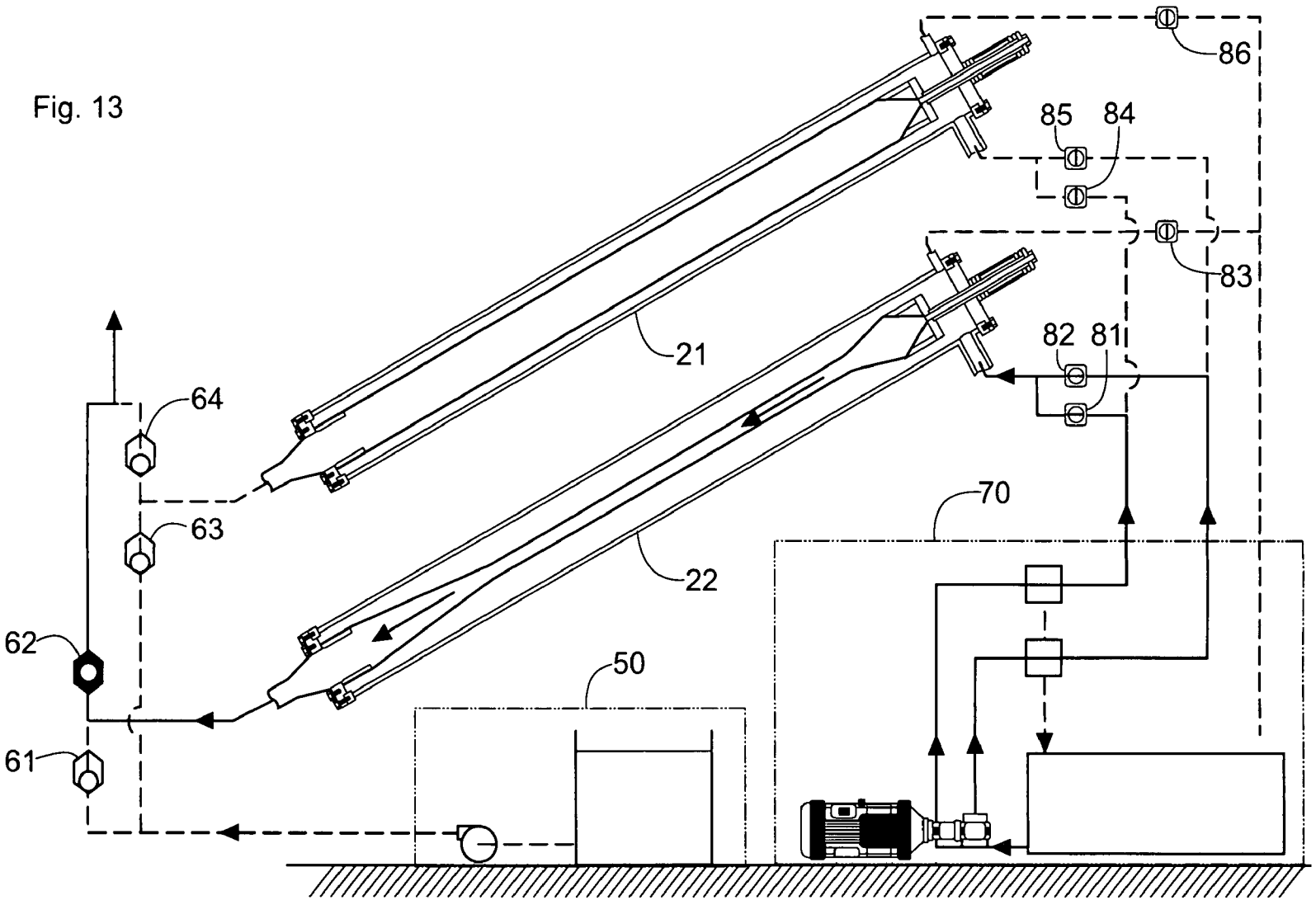

The control system is then operated to deliver hydraulic oil to the actuating chamber 40 of pump 22. As the hydraulic oil fills the actuating chamber 40 and actuating annulus 41 of pump 22, it causes the tube structure 27 exposed to the actuating fluid to, expell slurry contained therein through the port 42, along the discharge branch line 57 to pipeline 56, as shown in FIGS. 5 and 6. Near the completion of the discharge stroke of the pump 22, pump 21 commences its discharge stroke, as shown in FIG. 7. Constant pressure is achieved by simultaneously discharging both pumps 22, 21 for a momentary time, thereby ensuring constant flow of the slurry though delivery pipeline 56 is maintained during transition between pumps 21,22. Having established a smooth transition between pumps 21,22 the discharge stroke of pump 22 finishes followed by the commencement of its intake stroke, as shown in FIG. 8.

During the intake stroke, the slurry is delivered to the pump 22 by way of the delivery means 50. The cycle then repeats, as shown in FIGS. 9-13, so that slurry is continuously pumped through the discharge pipeline 56 by the two pumps 21, 22 operating in timed sequence, such that a constant flow is delivered by the pumping system 1.

In order for there to be a substantially un-interrupted delivery of pumped slurry to the discharge pipeline 56, it is necessary that the time taken to perform the intake stroke be quicker than the time allowed for the discharge stroke. This provides time necessary for the operation of the various control valves in the change-over-sequence from one pump to the other.

At the commencement of each pump stroke, the actuating annulus 41 and actuating chamber 40 of one pump is pressurised to the same pressure as the actuating annulus 41 and actuating chamber 40 of the other pump (which is nearing the end of its discharge stroke). If the actuating annulus 41 and actuating chamber 40 of the pump about to commence its discharge stroke is not so pressurised prior to commencement of its discharge stroke, there will be a pressure loss that will disrupt continuous delivery to the discharge pipeline 56.

During operation of the pumping system 1, it is most important to ensure that each pumping chamber 28 is fully filled with slurry prior to commencement of its pumping stroke. Without this requirement being satisfied, the tube structure 27 could ultimately be damaged after repeated discharge strokes within the respective pumping chamber 28. This could, for example, lead to the tube structure 27 being forced through the port 42.

In the event of excessive discharge from the tube structure 27, the tube structure will shorten in length as the volume of the pumping chamber 28 is decreased by the discharge of slurry, and given that the tube structure 27 is substantially inelastic. The movable support assembly, tubular rod 32 and spring 35 accommodate the shortening of the tube structure 27. The extent of the shortening can be measured, for example with reference to movement of the tubular rod 32. This can then be used to provide a signal indicating that the tube structure is fully discharged, that is, when the tubular rod 32 is in its inner most position the discharge stroke is complete.

There are various ways in which operation of the pumping system can be monitored to ensure that each pumping chamber 28 is filling correctly prior to commencement of a discharge stroke. One-way would involve monitoring the pressure differential existing between the actuating chamber 40 and the pumping chamber 28. By way of explanation, when slurry is entering one of the pumping chambers 28 through the respective port 42; actuating fluid is being discharged from the actuating chamber 40. In other words, the respective outlet control valve 83, 6 in the hydraulic circuit associated with that particular actuating chamber 40 is open to allow the expulsion of the actuating fluid. As there is minimal backpressure in the actuating chamber 40 (because the outlet valve 83,86 is open), the slurry can inflate the tube structure 27 as the actuating fluid is expelled. When the tube structure 27 is fully loaded, the delivery means 50 continues to apply pressure to the tube structure 27, with the pressure being absorbed by the tensile properties of the tube structure 27. The internal pressure within the tube structure 27 causes the tube structure 27 to become tight and so assume its maximum possible inflated condition. As the outlet valve 83, 86 from the actuating chamber 40 is still open when the tube structure 27 is in this condition, there will be no pressure exerted on the actuating fluid remaining in the actuating chamber 40 (as the tube structure 27 can expand no further). Consequently, there is a pressure differential which can be detected and thereby used to provide an indication that the pumping chamber 28 is fully loaded.

Another detection system may utilise the shortening effect of each tube structure 27 when it moves from a relaxed condition to a fully loaded condition. The shortening effect can be seen with reference to FIGS. 14-17 of the drawings. FIGS. 14 and 15 illustrate the closed end section of the tube structure 27 when it is fully loaded. As can be seen with reference to FIGS. 16 and 17, when the tube structure 27 is in a relaxed state, the radial expansion shown at 91 of the tube structure leads to longitudinal contraction, as shown at 90, with the result that there is an overall shortening of the tube structure 27. The shortening of the tube structure 27 is accommodated by the movable support assembly, tubular rod 32 and spring 35. The extent of the shortening can be measured, for example with reference to movement of the tubular rod 32. This can then be used to provide a signal indicating that the pumping chamber 28 is fully loaded, that is, when the tubular rod 32 is in its inner most position.

It should be understood that the end of the tubular structure 27 can be closed in any appropriate way.

The inclination of the pumps 21, 22 is so selected that if settlement of solid particles within the slurry were to occur while the slurry is within the pumping chamber 28, the settled particles will accumulate at the lower end of the pumping chamber 28 adjacent the port 42. The settled particles are then collected and discharged by the outgoing slurry charge during the next discharge stroke as a result of the higher velocity flow which exists at the outlet port 42.

From the foregoing, it is evident that the present invention provides a simple yet highly effective pumping system which can pump fluids at high pressure in a uniform flow regime. The pump system 1 can operate at relatively slow pumping cycles in comparison to the high operating cycles of conventional reciprocating piston type pumps and as such valve systems used in the pump system are operating under less arduous conditions. By way of example, each pump 21,22 within the pump system 1 can operate at a rate of about 2 to 4 cycles per minute which is significantly lower than the usual rate of 60 to 80 cycles per minute for conventional piston type pumps used in industrial environments.

It should be appreciated that the scope of the invention is not limited to the scope of the embodiment described. In this regard, it should be understood that a pumping system according to the invention may have applications in various areas where fluid pumping is required.

Further, it should be understood that while the pump system 1 according to the embodiment utilises two pumps 21, 22 operating in timed sequence, there may be applications where only one pump is required (where intermittent discharge flow is acceptable), or alternatively there may be applications where it is possible to use a series of more than two pumps operating in sequence.

Improvements and modifications may be incorporated without departing from the scope of the invention.

Throughout the specification, unless the context requires otherwise, the word "comprise" or variations such as "comprises" or "comprising", will be understood to imply the inclusion of a stated integer or group of integers but not the exclusion of any other integer or group of integers.

What is claimed is:

1. A pump for conveying a pumped fluid using an actuating fluid, the pump comprising: a rigid outer casing defining an interior space; and a tube structure accommodated in the interior space, the tube structure being flexible and inelastic, an interior of the tube structure defining a pumping chamber for receiving the pumped fluid, the tube structure being movable between laterally expanded and collapsed conditions for varying a volume of the pumping chamber thereby to provide discharge and intake strokes, a region of the interior space surrounding the tube structure defining an actuating region for receiving and accommodating the actuating fluid, the pumping chamber being configured to receive the pumped fluid to cause the tube structure to move towards the laterally expanded condition and the pumping chamber thereby undergoing an intake stroke, the pumping chamber undergoing a discharge stroke upon collapsing of the tube structure in response to an action of the actuating fluid in the actuating region, wherein one end of the tube structure is closed and the other end is connected to a port through which the pumped fluid enters into and discharges from the pumping chamber as the pumping chamber performs said intake and discharge strokes and the tube structure is movably supported to accommodate longitudinal extension and contraction of the tube structure and an axial length of the tube structure shortens during the intake stroke and increases during the discharge stroke.

2. A pump according to claim 1, wherein the tube structure is supported.

3. A pump according to claim 1, wherein the closed end of the tube structure is movably supported.

4. A pump according to claim 1, wherein the actuating region includes an actuating annulus surrounding the tube structure and an actuating chamber located at the closed end of the pump.

5. A pump according to claim 4, wherein the actuating annulus is in fluid communication with the actuating chamber.

6. A pump according to claim 1, further comprising: a device to bleed at least one of the pumped fluid and actuating fluid from the pump.

7. A pump according to claim 6 further comprising:

a separate device to bleed air from the pumping chamber and the actuating region, wherein the air is bled from the pumping chamber during the intake stroke and air is bled from the actuating region during the discharge stroke.

8. A pump according to claim 1, further comprising:

a monitoring device to monitor the pump during the intake and discharge stroke.

9. A pump according to claim 8, wherein the monitoring device monitors a condition of the tube structure.

10. A pump according to claim 8, wherein the monitoring device monitors, directly or indirectly, a position of the closed end of the tube structure.

11. A pump according to claim 8, wherein the monitoring device monitors a pressure differential between components of the pump.

12. A pump according to claim 8, wherein the monitoring device at least indicates when the discharge and intake strokes have been completed.

13. A pumping system comprising:

a pump in accordance with claim 1;

a delivery device for delivering the pumped fluid to the pumping chamber in timed sequence for causing the pumping chamber to undergo its intake stroke; and a supply device for supplying the actuating fluid to the actuating region in timed sequence to cause the tube structure to laterally collapse whereby the pumping chamber undergoes its discharge stroke.

14. A pumping system according to claim 13, wherein the delivery device includes a delivery pump.

15. A pumping system according to claim 13, wherein the actuating fluid is one of hydraulic oil and water.

16. A pumping system according to claim 15, wherein the actuating fluid is hydraulic oil.

17. A pumping system according to claim 16, wherein the supply device includes a hydraulic circuit incorporating a reservoir for the hydraulic oil and a hydraulic pump.

18. A pumping system according to claim 17, wherein the hydraulic circuit further includes an intake and exit valve system for regulating a delivery of hydraulic oil into, and a discharge of hydraulic oil from, the actuating region in timed sequence.

19. A pumping system according to claim 15 wherein the actuating fluid is water.

20. A pumping system according to claim 19, wherein the supply device includes a water reservoir at an elevated location in order to supply the water at an appropriate pressure head.

21. A pumping system according to claim 13, wherein a delivery of the actuating fluid to the actuating region is at an opposed end to the port through which the pumped fluid enters into and discharges from the pumping chamber.

22. A pumping system according to claim 13, wherein an outlet of the actuating fluid from the actuating region is also at an opposed end to the port through which the pumped fluid enters into and discharges from the pumping chamber.

23. A pumping system comprising: two pumps, each pump being in accordance with claim 1, a delivery apparatus for delivering the pumped fluid to respective pumping chambers of said two pumps in timed sequence for causing said respective pumping chambers to undergo their respective intake stroke; and a supplying apparatus for supplying the actuating fluid to respective actuating regions of said two pumps in timed sequence to cause their respective tube structures to laterally collapse whereby said respective pumping chambers undergo their respective discharge stroke, wherein the two pumps are operated sequentially such that the pumping chamber of one of said two pumps performs its intake stroke while the pumping chamber of the other of said two pumps performs its discharge stroke, and vice versa.

24. A pumping system according to claim 23 wherein the sequential operation of the two pumps is such that an uninterrupted supply of the pumped fluid is expelled from the pumping system.

25. A pumping system according to claim 23, wherein a duration of the discharge stroke is longer than a duration of the intake stroke.

26. A pumping system according to claim 23, wherein one pump completes its intake stroke and commences its discharge stroke while the other pump is completing its discharge stroke.

27. A pumping system according to claim 23, wherein the intake stroke of said one pump of said two pumps is completed by the time the discharge stroke from said other pump of said two pumps is completed and a discharge flow therefrom is equal in flow to a desired flow of the pumped fluid from the pumping system.

28. A pumping system according to claim 23, wherein the two pumps have a common delivery device and a common supply device, with appropriate valve systems controlling the sequence of operation.

29. A pumping system according to claim 23, wherein each pump is oriented so that the closed end of the tube structure is elevated in relation to the other end thereof.

30. A pumping system according to claim 23, wherein a delivery and exit of the actuating fluid to the actuating region is adjacent the closed end.

31. A pumping system comprising:

at least two pumps each pump being in accordance with claim 1;

a delivery device for delivering the pumped fluid to each pumping chamber of said at least two pumps in timed sequence, causing said each pumping chamber to undergo its intake stroke; and a supply device for supplying the actuating fluid to each actuating region of said at least two pumps in timed sequence to cause the respective tube structure of said at least two pumps to laterally collapse and the respective pumping chamber of said at least two pumps undergoing its discharge stroke, whereby the sequential operation of the at least two pumps expels an uninterrupted supply of the pumped fluid from the pumping system.

32. A pumping system according to claim 31, wherein the closed end of the pumping chamber is elevated in relation to the other end thereof.

33. A method of operating a pumping system in accordance with claim 31, wherein a duration of the discharge stroke of one pump of said at least two pumps is longer than a duration of the intake stroke of the other pump of said at least two pumps, and vice versa.

34. A pump for conveying a pumped fluid using an actuating fluid, the pump comprising:

a rigid outer casing defining an interior space; a flexible tube structure accommodated in the interior space, an interior of the tube structure defining a pumping chamber for receiving the pumped fluid, the tube structure being movable between laterally expanded and collapsed conditions for varying a volume of the pumping chamber thereby to provide discharge and intake strokes, one end of the tube structure being closed and the other end communicating with a port through which the pumped fluid can enter into and discharge from the pumping chamber as the pumping chamber performs the intake and discharge strokes, a region of the interior space surrounding the tube structure defining an actuating region for receiving the actuating fluid, the pumping chamber being adapted to receive the pumped fluid to cause the tube structure to move towards the laterally expanded condition and the pumping chamber thereby undergoing an intake stroke, the pumping chamber undergoing a discharge stroke upon collapsing of the tube structure in response to an action of the actuating fluid in the actuating region, and an axial length of the tube structure shortens during the intake stroke and increases during the discharge stroke.

35. A pump according to claim 34, wherein the tube structure is inelastic.

36. A pump according to claim 34, wherein the port through which the pumped fluid enters the pumping chamber is at an opposed end to where the actuating fluid enters the pump.

37. A pump for conveying a pumped fluid using an actuating fluid, the pump comprising: a rigid outer casing defining an interior space; and a tube structure accommodated in the interior space, the tube structure having one end closed and in an elevated position in to relation to the other end, which communicates with a port through which the pumped fluid enters into and discharges from the pumping chamber, an interior of the tube structure defining a pumping chamber for receiving the pumped fluid, the tube structure being movable between laterally expanded and collapsed conditions for varying a volume of the pumping chamber thereby to provide discharge and intake strokes, a region of the interior space surrounding the tube structure defining an actuating region for receiving the actuating fluid, the pumping chamber being configured to receive the pumped fluid to cause the tube structure to move towards the laterally expanded condition and the pumping chamber thereby undergoes an intake stroke, the pumping chamber undergoing a discharge stroke upon collapsing of the tube structure in response to an action of the actuating fluid in the actuating region, and an axial length of the tube structure shortens during the intake stroke and increases during the discharge stroke.

38. A pump according to claim 37, wherein the actuating fluid enters the actuating region adjacent the closed end of the pumping chamber.

39. A pump according to claim 37, wherein the tube structure is flexible and inelastic.

* * * * *